United States Patent [19]

Cole

[11] 3,996,026

[45] Dec. 7, 1976

[54] PROCESS FOR FEEDING A HIGH SOLIDS CONTENT SOLID FUEL-WATER SLURRY TO A GASIFIER

[75] Inventor: Edward L. Cole, Fishkill, N.Y.

[73] Assignee: Texaco Inc., New York, N.Y.

[22] Filed: Feb. 27, 1976

[21] Appl. No.: 661,888

Related U.S. Application Data

[63] Continuation-in-part of Ser. No. 608,115, Aug. 27, 1975, abandoned.

[52] U.S. Cl. ..... 48/197 R; 48/202; 48/DIG. 7; 44/51; 110/7 S; 252/373; 302/66

[51] Int. Cl.[2] ..... C10J 3/06

[58] Field of Search ..... 48/197 R, 200, 201, 48/202, 206, DIG. 7; 44/51; 302/14, 66; 252/373; 110/7 S

[56] References Cited

UNITED STATES PATENTS

| | | | |
|---|---|---|---|
| 827,139 | 2/1905 | Browne et al. | 44/51 |
| 1,390,230 | 9/1921 | Bates | 44/51 |
| 2,669,509 | 2/1954 | Sellers | 48/206 |
| 3,359,040 | 12/1967 | Every et al. | 302/14 |
| 3,607,156 | 9/1971 | Schlinger et al. | 48/206 |
| 3,620,698 | 11/1971 | Schlinger et al. | 48/206 |

*Primary Examiner*—S. Leon Bashore
*Assistant Examiner*—Peter F. Kratz
*Attorney, Agent, or Firm*—T. H. Whaley; C. G. Ries; Robert Knox, Jr.

[57] ABSTRACT

Water-solid fuel slurries suitable for use as feed to a solid fuel gasifier are prepared by forming a ground solid fuel-water mixture containing about 35–55 wt. % water, adding sufficient organic liquid to form a pumpable slurry, pumping the slurry through a heating zone to a separator, and separating organic liquid from the fuel-water mixture.

10 Claims, No Drawings

PROCESS FOR FEEDING A HIGH SOLIDS CONTENT SOLID FUEL-WATER SLURRY TO A GASIFIER

This application is a continuation-in-part of my copending application Ser. No. 608,115 filed Aug. 27, 1975 and now abandoned.

This invention relates to the production of solid fuel-water slurries. More particularly, it is concerned with the production of slurries of solid fuel in water suitable for feed to a generator for the conversion of the solid fuel to a gaseous fuel or to synthesis gas.

The gasification of solid fuels such as coal is well known. Several methods have been proposed for such a procedure in which the solid fuel is ground to a fine powder and fed to the gas generator as a suspension in a vaporous medium e.g., steam or in a gaseous medium such as a free oxygen-containing gas. However, these methods are unsatisfactory as it is difficult to control the amount and rate of solid fuel fed to the gas generator. In addition, if the solid fuel is suspended in a free oxygen-containing gas, care must be taken to maintain the velocity of the suspension above the rate of flame propagation to avoid a backflash resulting in considerable damage to the equipment.

It has also been proposed to feed powdered solid fuel or coal into the gasification reactor suspended in liquid such as water. This too, has some disadvantages as the fuel should be in the form of a pumpable slurry. Ordinarily a pumpable slurry of solid fuel or coal requires the addition of water to the powdered fuel to form a slurry containing not more than about from 40 to 45 wt. % coal. As the solids content increases above this range the slurry becomes increasingly difficult to pump and at about 50% solids content, it is unpumpable. Actually such slurries contain in excess of 50% water as there is a considerable amount of water in coal as mined such as occasional water or surface water which may be easily removed by heating the coal or solid fuel to a temperature just above 100° C, and occluded water, which is found in the smaller pores and requires additional heating for removal. The coal or solid fuel also contains chemically bound water. This water is present in the coal as mined and plays no part in the pumpability of the slurry so that, depending on the type of solid fuel, a pumpable slurry may contain as little as about 30 to 35 wt. % solids on a dry basis. Such a slurry is not a satisfactory feed for a gas generator as the large amount of water present results in a reaction zone temperature that is too low for satisfactory operation.

It is therefore an object of this invention to produce solid fuel-water slurries having high solids content. Another object is to form solid fuel-water slurries suitable for use as feed to a gas generator wherein the water content is between 35 and 55 wt. %, more preferably between 35 and 50 wt. %.

Accordingly our invention provides a process for the gasification of a solid fuel which comprises adding water to a finely-divided solid fuel to form a slurry having a total water content between 35 and 55% by weight, adding sufficient organic liquid of a type selected to improve the pumpability of said slurry to the slurry to form a pumpable slurry, heating the resulting slurry under pressure sufficient to maintain the water in liquid phase, separating at least a portion of the organic liquid from the heated slurry and injecting the remaining mixture into a solid fuel gasification zone.

The type of organic liquid or non-aqueous liquid medium selected to improve the pumpability of the original slurry will depend on the particular circumstances involved. When the non-aqueous liquid medium is cheap and/or easily available and has little or no effect on the operation of the gasifier, it is not important if its separation from the slurry prior to the introduction of the slurry into the gasifier is less than complete. An example of such non-aqueous liquid medium would be a residual oil if the gasifier is situated reasonably close to a petroleum refinery. However, if the organic liquid or non-aqueous liquid medium is expensive or difficult to obtain then advantageously a substantially complete separation is made prior to the introduction of the solid fuel-water mixture into the gasifier and the separated liquid advantageously is recycled to the slurrying zone. Examples of such materials are naphtha, hexanes, pentanes, methyl alcohol and the like. By converting the solid fuel-water mixture into a pumpable slurry in the first instance, it becomes easy to transport the solid fuel from the slurrying zone through various pieces of equipment such as pipes, pumps, compressors, heat exchangers and the like. Yet by my process, the mixture going into the gasifier contains the preferred amount of only from about 35 to 50 or 55 wt. % water and therefore need not produce an undesirably low temperature in the partial oxidation zone.

The process of my invention may be applied to any solid fuel such as coal or coke and the like but it is particularly adapted to sub-bituminous coal and lignite which contain relatively large amounts of water as mined. Suitably the solid fuel is ground so that at least 70% passes through a 200 mesh sieve and preferably at least 70% passes through a 325 mesh sieve (U.S.A. Standard Series).

The organic liquid or non-aqueous liquid medium used to improve the pumpability of the initial slurry may be composed of any petroleum refinery stream such as residual oil, vacuum gas oil, FCCU cycle gas oil, atmospheric gas oil, kerosine, naphtha, compounds and mixtures of compounds such as normal and isoparaffins ranging from $C_4$ to $C_{20}$, cyclohexane and oxygen-containing liquids such as methyl and ethyl alcohol, and mixtures thereof.

A preferred class of liquids are those which facilitate slurry formation at substantially room temperature but which when heated to separation temperature are above their critical temperature and at the separator pressure, exist as gases having about the same density as the liquid near the critical temperature. Particularly suitable materials are those that form a slurry with the coal-water mixture at temperatures below about 200° F. but when passed through the heater into the separator are above their critical temperature and at the pressure in the separator, exist as super critical liquids. Particularly suitable organic liquids are low molecular weight hydrocarbons or oxygen-containing compounds such as ethers, alcohols and ketones and their mixtures. Those most particularly preferred have a molecular weight below about 150. A non-limiting list of preferred compounds is tabulated below in Table 1.

TABLE 1

| Compound | Critical Temp., ° F. | Pressure at Critical Temp. Pounds/sq. Inch |
|---|---|---|
| Propane | 206 | 642 |
| n-Butane | 306 | 544 |

TABLE 1-continued

| Compound | Critical Temp., ° F. | Pressure at Critical Temp. Pounds/sq. Inch |
|---|---|---|
| n-Pentane | 387 | 482 |
| n-Hexane | 455 | 433 |
| n-Heptane | 512 | 394 |
| n-Octane | 565 | 362 |
| n-Nonane | 613 | 332 |
| n-Decane | 654 | 308 |
| Methyl Alcohol | 464 | 1160 |
| Cyclohexane | 538 | 597 |

In one embodiment of my invention, coal is ground to a suitable particle size and then mixed with sufficient water to produce a mixture containing between 40 and 45 wt. % total water. A hydrocarbon liquid is then added in an amount sufficient to form a pumpable mixture, that is, one having a viscosity of less than about 2,000 centipoise. The slurry is preferably kept well mixed by being agitated while recycling a portion thereof to the slurry vessel. The slurry then is picked up by a piston pump and passed through a heater and at a pressure substantially the same as the generator pressure is introduced into a separator from which the hydrocarbon is separated from the water-coal mixture. The hydrocarbon is recycled to the slurrying zone after being cooled by heat exchange with the cold feed streams. The coal-water mixture from which the hydrocarbon has been removed exists as a thick slurry that flows from the separator into the trough of a screw conveyor through which it passes and is fed to the gasifier.

The pressure-temperature conditions in the separator are important. Preferably the piston pump develops an outlet pressure about equal to that of the gasifier, since under ordinary circumstances a screw conveyor is unable to pump against a high pressure and in service the screw conveyor will suffer wear so that unless sufficient back pressure in maintained the screw conveyor will lose its characteristic as a seal between the separator and the gasifier. In addition, elevated temperatures in the separator are desirable as higher temperatures reduce the heat load in the gasifier and facilitate separation of the hydrocarbon from the coal-water mixture.

The preferred materials are easily separable from the coal-water system just prior to its introduction into the gasifier. High molecular weight oils such as residua tend to form oil-water-coal emulsions that are difficult to separate under the prevailing temperature-pressure conditions of the separator and result in losses of oil to the gasifier. From a standpoint of minimizing loss to the gasifier those materials are preferred which (a) exist as liquid under slurry-forming conditions but (b) exist as a super-critical liquid under system conditions, i.e. above the critical temperature but at a pressure above the critical pressure.

It will be realized by those skilled in the art that only enough liquid need be added to the solid fuel-water mixture to form a pumpable slurry. Organic liquid in excess of that amount may be added but the additional cost of separating the excess liquid and recycling it to the slurry vessel should be borne in mind.

The following examples are submitted for illustrative purposes only and it should not be construed that the invention is restricted thereto.

EXAMPLE I

In this example the solid fuel is a sub-bituminous coal having the following proximate analysis:

TABLE 1

| | |
|---|---|
| Moisture, % | 37.9 |
| Ash, % | 9.3 |
| Volatile Matter, % | 25.8 |
| Fixed Carbon, % | 27.0 |
| Heat of Combustion | |
| Gross, BTU/lb. | 6476 |
| Sieve Analysis | 75% through 200 mesh |

In a series of tests, pumpable coal-water-organic liquid slurries were formed using liquids having the characteristics tabulated below:

TABLE 2

| | Residual Oil | Kerosine | n-Hexane |
|---|---|---|---|
| API Gravity | 15.5 | 43.4 | 84.3 |
| Viscosity | 432 c.s. at 122° F | 1.4 c.s. at 100° F. | — |
| Carbon Residue, % | 15.5 | 0.1 | — |
| Distillation Range, ° F. | >650 | 400–570 | 140–157 |

After the slurries had been formed, they were heated and pressured and then introduced into a separator for removal of the organic liquid. Experimental data appear below:

TABLE 3

| | A | B | C |
|---|---|---|---|
| Coal, parts by wt. (mf) | 100 | 100 | 100 |
| Water, parts by wt. | 75.5 | 75.5 | 75.5 |
| Residual oil, parts by wt. | 50 | — | — |
| Kerosine, parts by wt. | — | 25 | — |
| n-Hexane, parts by wt. | — | — | 35 |
| Slurry Preparation Temp., ° F. | 180 | 78 | 75 |
| Heater Outlet Temp., ° F. | 475 | 465 | 460 |
| Separator Temp., ° F. | 465 | 460 | 460 |
| Separator Pressure, psig | 1100 | 1100 | 1100 |
| Parts of hydrocarbon loss | 20 | 3 | 0.55 |
| Hydrocarbon loss, lbs. per ton of coal (mf) | 400 | 60 | 11 |

The abbreviation mf indicates that the coal was measured on a moisture-free basis.

The above data show that when residual oil is added to a mixture composed of 43% water and 57% coal measured on a moisture-free basis to convert the mixture to a pumpable slurry and the oil is then separated from the mixture at the temperature and pressure at which the mixture would be injected into a gasification zone, the separation is poor and it is apparent that 400 pounds of oil per ton of coal measured on a moisture-free basis would be injected into the gasifier with the coal water mixture. When kerosine is used to convert the mixture into a pumpable slurry, the separation is much more efficient in that only 60 pounds of kerosine per ton of coal would be introduced into the gasifier. However, when n-hexane is used the separation is substantially complete and only 11 pounds of n-hexane per ton of coal is lost to the gasifier. The last is the preferred type of organic liquid used in our process.

At the separator pressure n-hexane is above its critical temperature of 455° F. but at the pressure of the system, 1100 psig, n-hexane exists as a dense gas having a density of 0.2344 grams per cc. At the same conditions water is a liquid having a density of 0.823 grams per cc. Such density differences facilitate the separation of n-hexane from the water and the coal. Another important feature of the preferred class of liquids is that at above the critical temperature their solubility in the coal and water is greatly reduced.

EXAMPLE II

This example is similar to Example I in that several different hydrocarbon liquids are used. The solid fuel in this example is a sub-bituminous coal which after air drying and milling has the following proximate analysis.

| | |
|---|---|
| Moisture, % | 17.4 |
| Ash, % | 20.6 |
| Volatile matter, % | 33.2 |
| Fixed Carbon, % | 28.8 |

A sieve analysis of the coal showed that 100% passed through a 60 mesh screen and 91.3% passed through a 200 mesh screen. Three mixtures containing approximately 65% coal and 35% water were formed. These mixtures were not pumpable. To each mixture a hydrocarbon liquid was added to form a pumpable slurry. These liquids were respectively n-hexane, kerosine and Arabian light vacuum gas oil which last had an API gravity of 24.4, a viscosity of 11.6 cs at 150° F., a pour point of 90° F. The slurries involving n-hexane and kerosine were prepared at ambient temperature whereas the slurry involving the Arabian vacuum gas oil was prepared at 100° F. The slurries were heated to 490° F. and pressurized to 900 psig at which conditions a separation of hydrocarbon liquid was made from the coal water mixture.

Experimental data are tabulated below.

TABLE 4

| Run | D | E | F |
|---|---|---|---|
| Parts Coal | 50.0 | 50.0 | 50.0 |
| Parts Water Added | 14.0 | 14.0 | 14.3 |
| Total Coal-Water | 64.0 | 64.0 | 64.3 |
| Water, % | 35.4 | 35.4 | 35.7 |
| Hydrocarbon | n-Hexane | Kerosine | Arabian VGO |
| Parts Hydrocarbon Added | 67.1 | 96.5 | 69.7 |
| Composition of Slurry | | | |
| Water, % | 17.3 | 14.1 | 17.2 |
| Coal (mf.), % | 31.5 | 25.8 | 30.8 |
| Hydrocarbon, % | 51.2 | 60.2 | 52.0 |
| Pounds of Hydrocarbon lost per ton of dry coal | 16 | 72 | 387 |

As in Example I, the above data show that in the case of n-hexane, separation at 490° F. and 900 psig was substantially complete, that in the case of kerosine, a considerable amount was retained in the coal-water mixture and in the case of the Arabian vacuum gas oil, a substantial amount of the hydrocargon liquid was retained in the coal-water mixture.

EXAMPLE III

The solid fuel in this example is a lignite having the following proximate analysis:

| | |
|---|---|
| Moisture, % | 36.2 |
| Ash, % | 7.7 |
| Volatile Matter, % | 29.1 |
| Fixed Carbon, % | 27.0 |

After grinding, over 44% of the powdered lignite passed through a 200 mesh screen. To 50 grams of the lignite, 16.2 grams of n-hexane was added to form a pumpable slurry whose composition calculates to be

| | |
|---|---|
| Lignite, wt. % mf | 48.2 |
| Water, wt. % | 27.4 |
| n-Hexane, wt. % | 24.4 |

The slurry is pumped through a tube furnace heater where its temperature is raised to 500° F. and its pressure to 1,200 psig under which conditions the n-hexane is kept in a dense phase. The slurry is then introduced into a separator where 98.5 wt. % of the n-hexane is recovered. This represents a loss of 15.2 pounds of n-hexane per ton of coal (mf.). The water-coal mixture feed to the gasifier contains 36 wt. % moisture.

EXAMPLE IV

This example is similar to Example II in that the same solid fuel used in Example III is formed into 3 pumpable slurries using iso-octane and the kerosine and Arabian light vacuum gas oil used in Example II. As in Example III, the slurries are pumped through a tube furnace heater where the temperature is raised to 500° F. and the pressure to 1100 psig. The slurries are then introduced to a separator where a separation is made between the hydrocarbon liquid and the coal and water. Experimental data are tabulated below:

TABLE 5

| Run | H | I | J |
|---|---|---|---|
| Parts lignite | 50.0 | 50.0 | 50.0 |
| Water, wt. % | 36.2 | 36.2 | 36.2 |
| Hydrocarbon Liquid | Iso-octane | Kerosine | Arabian VGO |
| Parts added | 19.4 | 23.8 | 26.8 |
| Composition of slurry | | | |
| Water, W. % | 26.0 | 24.5 | 23.6 |
| Lignite, dry, wt. % | 46.0 | 43.2 | 41.5 |
| Hydrocarbon liquid, wt. % | 28.0 | 32.3 | 34.9 |
| Pounds of Hydrocarbon list per ton of lignite, mf. | 20 | 62 | 370 |

In the foregoing description, parts and percentages are by weight unless otherwise specified.

Solid fuel-water mixtures prepared according to our process are suitable as feed to a gas generator for the production of synthesis gas or reducing gas in that the rate of feed can be controlled yet there is not excessive amount of water present in the feed to affect the operation of the generator by causing an undesirably low temperature in the gas generation zone. It will be appreciated that the amount of organic liquid which should be added will depend on the particle size of the fuel and the amount of water in the fuel available for slurrying purposes.

Various modifications of the invention as hereinbefore set forth may be made without departing from the spirit and scope thereof, and therefore, only such limitations should be made as are indicated in the appended claims.

The embodiments of the invention in which an exclusive property or privilege is claimed are defined as follows:

1. In a process for the gasification of a solid fuel which comprises adding water to a finely-divided solid fuel to form a mixture having a total water content between 35 and 55% by weight, the improvement which comprises adding sufficient organic liquid of a type selected to improve the pumpability of said mixture to the mixture to form a pumpable slurry, heating the resulting slurry under pressure sufficient to maintain the water in liquid phase, separating at least a portion of the organic liquid from the heated slurry and then injecting the remaining mixture into a solid fuel gasification zone.

2. The process of claim 1 in which the organic liquid is removed from the slurry as a liquid.

3. The process of claim 1 in which the organic liquid is removed from the slurry as a dense gas.

4. The process of claim 1 in which the organic liquid is a hydrocarbon liquid.

5. The process of claim 4 in which the organic liquid is a petroleum naphtha.

6. The process of claim 1 in which the organic liquid contains oxygen.

7. The process of claim 6 in which the organic liquid is an alcohol.

8. The process of claim 1 in which the separated organic liquid is recycled to form additional slurry.

9. The process of claim 1 in which the solid fuel is a sub-bituminous coal.

10. The process of claim 1 in which the solid fuel is lignite.

* * * * *